United States Patent [19]

Parrott et al.

[11] Patent Number: 4,960,171

[45] Date of Patent: Oct. 2, 1990

[54] CHARGE PHASING ARRANGEMENTS IN A PERFORATING GUN

[75] Inventors: Robert A. Parrott, Houston; Gary M. Lendermon, Missouri City, both of Tex.

[73] Assignee: Schlumberger Technology Corporation, Houston, Tex.

[21] Appl. No.: 391,807

[22] Filed: Aug. 9, 1989

[51] Int. Cl.[5] ..... E21B 43/116

[52] U.S. Cl. ..... 166/55; 166/297; 175/4.55; 175/4.51; 175/4.6

[58] Field of Search ..... 166/55, 55.1, 55.2, 166/63, 297, 318; 175/4.6, 4.51, 4.56, 4.55

[56] References Cited

U.S. PATENT DOCUMENTS

| | | | |
|---|---|---|---|
| 2,327,141 | 8/1943 | Spencer | 175/4.54 |
| 2,896,718 | 7/1959 | Kibby | 175/4 |
| 3,043,379 | 7/1962 | Porter | 175/4 |
| 3,209,828 | 10/1965 | Lebourg | 175/4 |
| 3,338,317 | 8/1967 | Shore | 175/4.51 |
| 3,589,453 | 6/1971 | Venghiattis | 175/4.6 |
| 3,842,918 | 10/1974 | Wolk | 175/4 |
| 4,140,188 | 2/1979 | Vann | 166/63 |
| 4,194,577 | 3/1980 | Vann | 175/4.51 |
| 4,726,431 | 2/1988 | Oestreich et al. | 175/4.6 |
| 4,744,424 | 5/1988 | Lenderma | 175/4.51 |
| 4,844,170 | 7/1989 | Gill | 175/4.6 |

OTHER PUBLICATIONS

Brochure, "DMI T.O.P. Gun", by Drilling Measurements Inc.

*Primary Examiner*—Ramon S. Britts

*Assistant Examiner*—Roger J. Schoeppel

*Attorney, Agent, or Firm*—John H. Bouchard; Henry N. Garrana

[57] ABSTRACT

Various charge phasing arrangements in a perforating gun include those uniquely associated with phasing solely along a 180 degree circumference of the perforating gun, for use in but not limited to deviated boreholes. One phasing arrangement comprises four rows of charges, four corresponding rows of recesses in the perforating gun carrier and four corresponding rows of holes in the loading tube, the recesses, holes and charges being constrained within a 180 degree circumference of the perforating gun. The two outermost rows have more recesses, more holes and more charges than do the two innermost rows, since more well fluid is interposed between the two outermost rows and the casing than is interposed between the two innermost rows and the casing of the borehole. Another phasing arrangement comprises five rows of charges, recesses and holes, in lieu of the four of the former embodiment, constrained within the 180 degree circumference, adjacent rows being disposed more closely together in this embodiment than in the former embodiment. A third phasing arrangement comprises eighteen rows of charges, recesses and holes disposed around the entire 360 degrees of the circumference of the gun and borehole.

The recesses, holes and charges in all embodiments are uniformly distributed to prevent splitting of the borehole casing, and the charge density in shots per foot for all embodiments of invention is high enough to ensure that a significant quantity of formation fluid is produced from the surrounding formation.

17 Claims, 4 Drawing Sheets

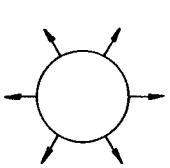
FIG. 3a
(PRIOR ART)
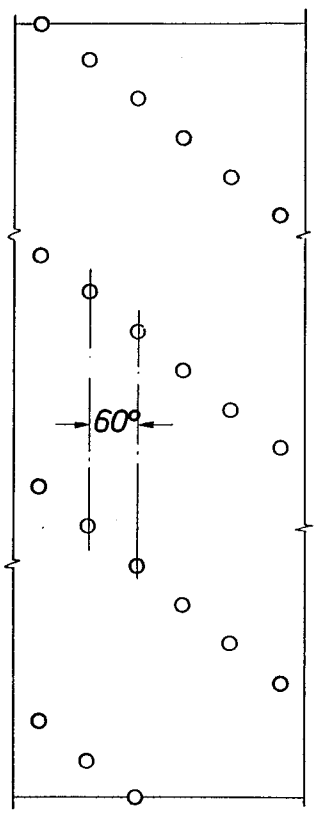
FIG. 4
(PRIOR ART)
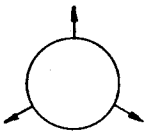
FIG. 3b
(PRIOR ART)
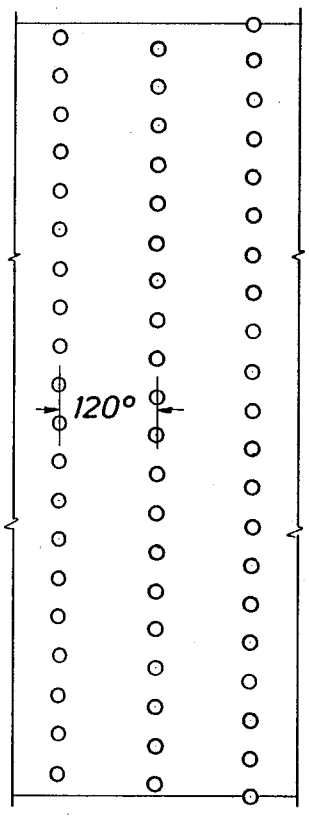
FIG. 2a
(PRIOR ART)
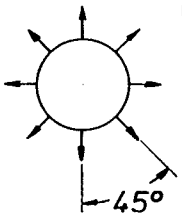
FIG. 2b
(PRIOR ART)
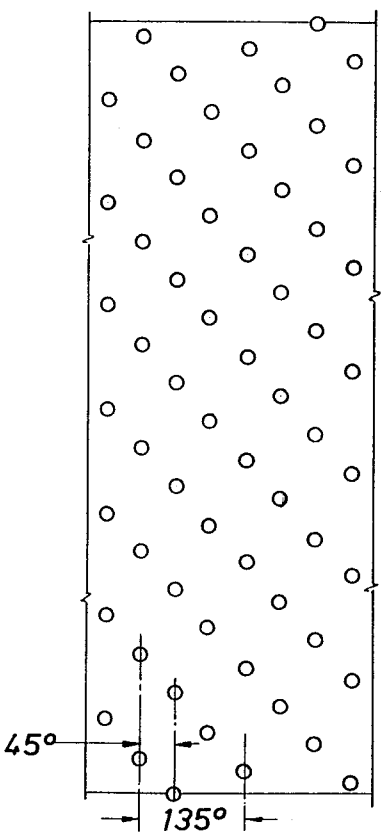

FIG. 5
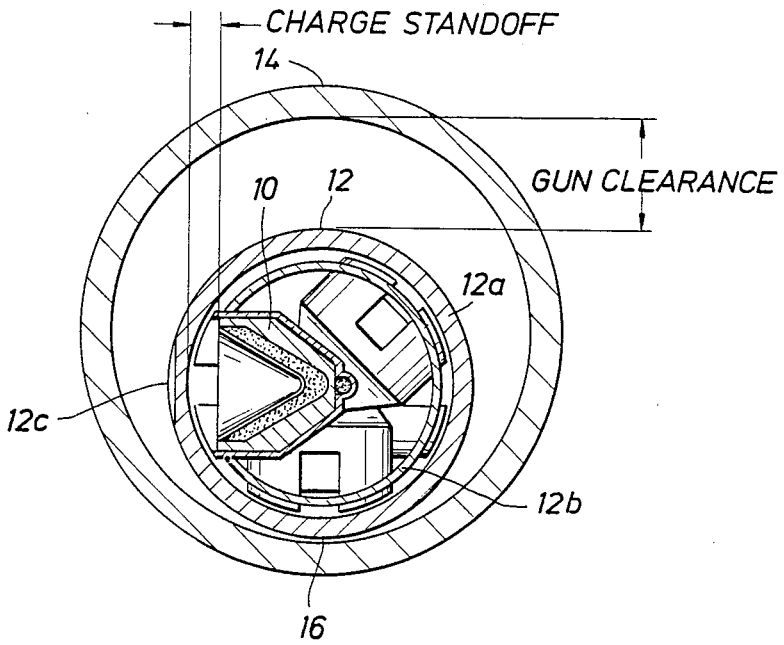
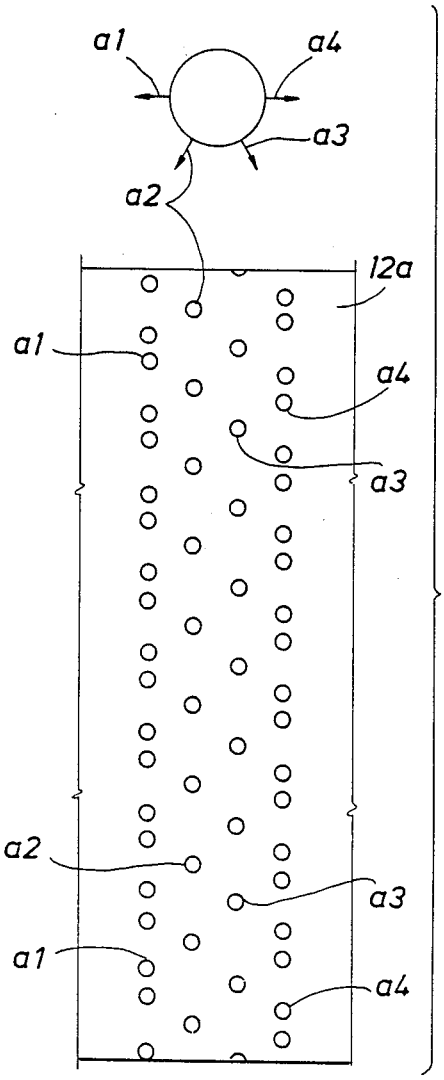
FIG. 6
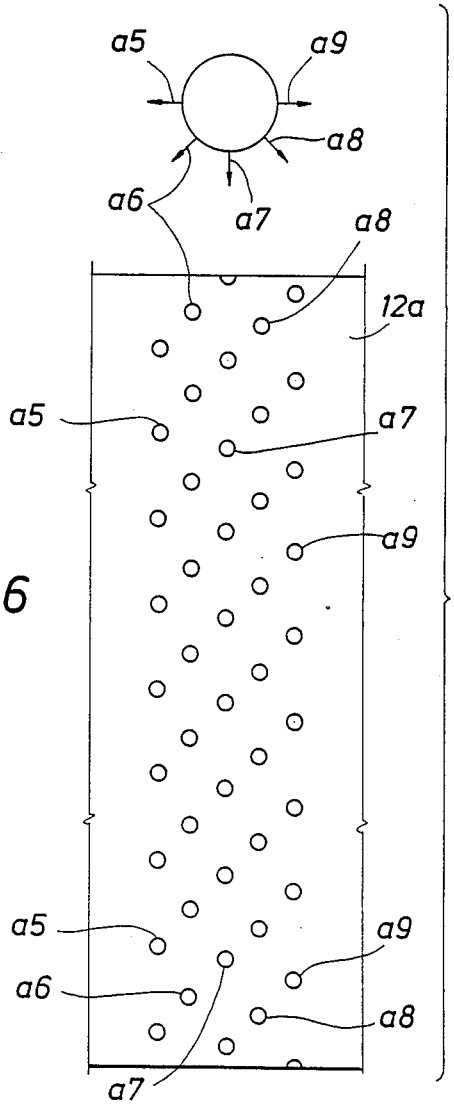
FIG. 7

CHARGE PHASING ARRANGEMENTS IN A PERFORATING GUN

BACKGROUND OF THE INVENTION

The subject matter of the present invention relates to perforating guns for perforating oil well boreholes, and more particularly, to various phasing arrangements of charges in the perforating gun, such as an arrangement for producing an asymmetrical pattern of recesses in the perforating gun carrier and subsequently the same pattern of holes in an oil well borehole casing.

Perforating guns are used to perforate a formation surrounding an oil well borehole, or perhaps a casing which lines the borehole formation. Some perforating guns are used in deviated boreholes, such as horizontal boreholes. These perforating guns contain charges that are usually directed in a substantially downward direction. However, two very important parameters must be carefully considered when designing a perforating gun for use in deviated boreholes: (1) the density (in shots per foot) of the charges in the gun, and (2) the relative distribution (phasing) of the charges in the gun. The charge density and distribution parameters are important, since these parameters determine the flow rate of the formation fluids from the formation, and the strength of the casing after the charges in the gun have detonated. Unless the density of the charges in the perforating gun is carefully selected, taking into consideration the phasing and relative distribution of the charges per foot, the flow rate of the fluids originating from the formation may be too low to properly justify, from a cost effectiveness point of view, the use of the deviated well, and the strength of the casing, after charge detonation, may be too weak to justify continued use of the deviated well. Therefore, when designing a perforating gun, for use in deviated boreholes, in order to optimize flow rate of formation fluids originating from the formation and simultaneously maintain maximum casing strength, great care must be taken with respect to selection of the proper density of the charges in the gun, per foot, the degree or nature of the phasing of the charges and the distribution of the charges in the gun.

SUMMARY OF THE INVENTION

Accordingly, it is a primary object of the present invention to design a perforating gun wherein the charges are pointed in a direction which lies within a 180 degree angle relative to the circumference of the gun and the charge density per foot along a surface parallel to the longitudinal axis of the gun is at least 4 shots per foot and preferably at least 8 shots per foot.

It is a further object of the present invention to design a perforating gun wherein the charges in the gun are angularly oriented relative to one another in a particular unique manner so as to create a uniformly distributed pattern of recesses in a carrier enclosing the gun.

It is a further object of the present invention to orient the charges in the perforating gun in the unique manner so as to create the uniformly distributed pattern of recesses in the carrier enclosing the gun while simultaneously pointing the charges in the direction which lies within the 180 degree angle relative to the circumference of the gun.

It is a further object of the present invention to design a perforating gun wherein the charges are uniquely oriented so as to create the uniformly distributed pattern of recesses in the carrier, the charges are pointed in the direction which lies within the 180 degree angle, and at least two rows of the charges which lie along a surface parallel to the longitudinal axis of the gun include more charges per foot than do the remaining longitudinally disposed rows of charges in the perforating gun.

It is a further object of the present invention to design a perforating gun wherein the charges are uniquely oriented so as to create the uniformly distributed pattern of recesses in the carrier, the charges are pointed in the direction which lies within the 180 degree angle, and at least two rows of the charges which lie along a surface parallel to the longitudinal axis of the gun each include at least twice as many charges per foot than do the remaining longitudinally disposed rows of charges in the perforating gun.

It is a further object of the present invention to design a perforating gun including rows of charges wherein two adjacent rows are disposed at a first unique angle, and wherein the angular orientation of two adjacent charges along the same longitudinal axis is defined to be a second unique angle, the first unique angle and the second unique angle being carefully selected so as to produce a minimum acceptable flow of formation fluid from a surrounding formation and a minimum acceptable strength of a casing enclosing the perforating gun and lining the borehole.

These and other objects of the present invention are accomplished by designing a perforating gun having phased charges disposed therein, the charges being phased solely within a 180 degree angle relative to a circumference of the perforating gun, the charges pointing downwardly when disposed in a deviated borehole, the charges being uniformly distributed within the 180 degree partial circumference of the gun thereby producing a uniform pattern of recesses in the perforating gun carrier and, when the charges are detonated, a corresponding uniform pattern of holes in the borehole casing. In one preferred embodiment, there are at least three and preferably four rows of recesses in the perforating gun carrier reflecting at least three and preferably four rows of charges disposed within the 180 degree partial circumference of the perforating gun. The two outermost rows of recesses in the gun carrier each include a first number of recesses, and the two innermost rows of recesses in the carrier each include a second number of recesses, where the first number of recesses is greater than the second number of recesses. In the preferred embodiment, the first number of recesses is twice that of the second number of recesses. In a deviated borehole environment, a space between each of the two outermost rows of recesses in the gun carrier and the borehole casing includes well fluids, whereas a space between the two innermost rows of recesses in the gun carrier and the borehole casing includes very little, if any, well fluids. This arrangement takes advantage of the fact that the charges perform substantially better after shooting through the increased amounts of wellbore fluid encountered by charges in rows a1 and a4 versus charges in rows a2 and a3. With the higher relative performance of the charges in rows a1 and a4 versus the charges in rows a2 and a3 and the higher percentage of charges in rows a1 and a4 (two thirds in rows a1 and a4, one third in rows a2 and a3) the overall gun system performance is maximized. Since the pattern of recesses (and charges) is uniformly distributed along the 180 degree partial circumference of the gun, the charges being pointed in the downward direction, when the charges detonate, the casing of the borehole will not be split in half. In addition, the uniform pattern of recesses and charges along the 180 degree partial circumference of the gun is also characterized by a minimum charge density per foot (i.e., a minimum number of shots per foot along a surface parallel to the longitudinal axis). Consequently, a significant quantity of formation fluid will be produced from the casing and formation beneath the gun, even though only half of the borehole (180 degrees) is being perforated. Therefore, the casing strength is maintained, and the formation fluid production from the formation is significant enough to render the wellbore profitable.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein

FIG. 2*a* illustrates a prior art perforating gun having a 45° charge phasing;

FIG. 2*b* illustrates a flat, opened-up section of the gun of FIG. 2*a* having a "135/45" charge arrangement and a shot density of 12 shots per foot;

FIG. 3*a* illustrates a prior art perforating gun having 120° charge phasing;

FIG. 3*b* illustrates a flat, opened-up section of the gun of FIG. 3*a* having a "120/120" charge arrangement and a shot density of 12 shots per foot;

FIG. 4 illustrates a prior art perforating gun having a 60/60 charge phasing arrangement and a shot density of 5 shots per foot;

FIG. 5 illustrates a perforating gun disposed in a deviated borehole lined by a casing, the gun resting on a casing within the deviated section of the borehole;

FIG. 6 represents a particular charge phasing arrangement in a perforating gun in accordance with one embodiment of the present invention, this arrangement representing the 10 shots per foot charge density embodiment distributed along a 180 degree partial circumference of the perforating gun;

FIG. 7 represents another particular charge phasing arrangement in a perforating gun in accordance with another embodiment of the present invention, this arrangement representing the 9 shots per foot charge density embodiment distributed along a 180 degree partial circumference of the perforating gun;

DETAILED DESCRIPTION OF THE PREFERRED EMBODIMENT

Figure 1A:
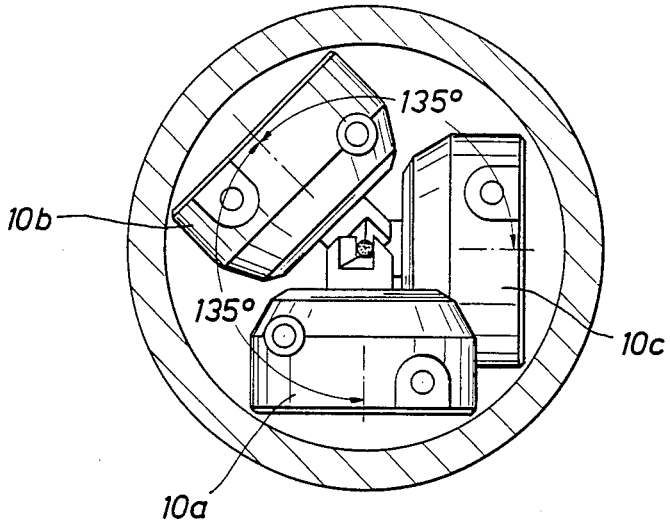
FIG. 1a (PRIOR ART)
FIG. 1*a* illustrates a plan view of a typical prior art perforating gun containing phased charges having a given charge density and charge phasing relationship.
Figure 1B:
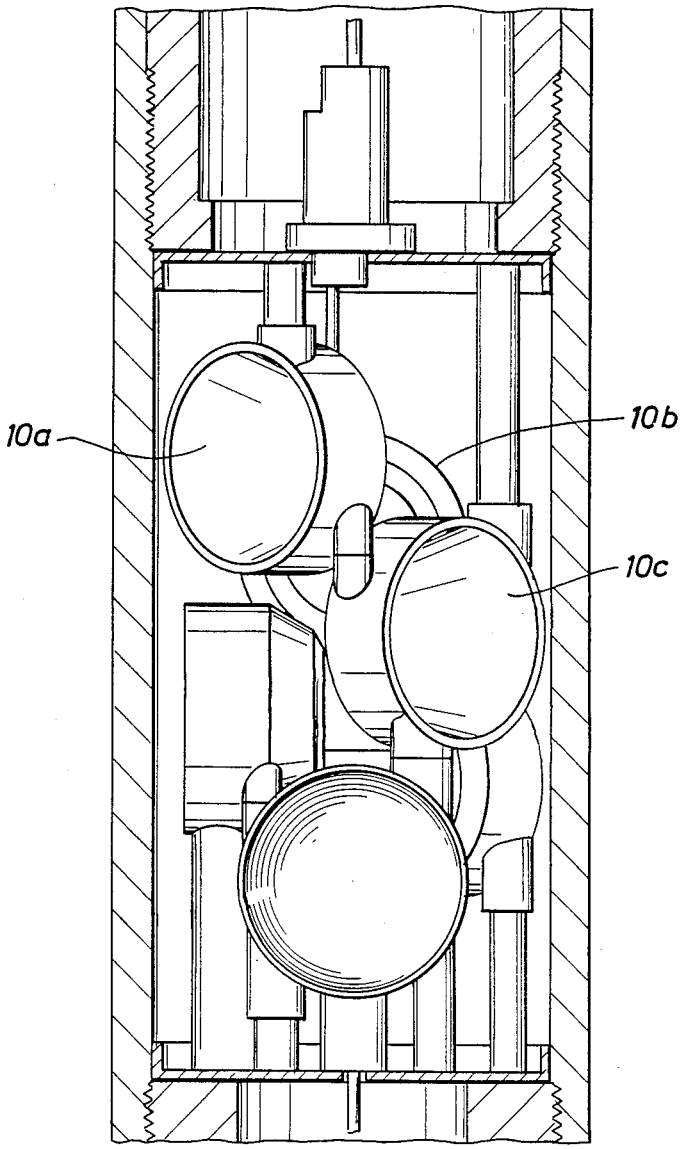
FIG. 1b (PRIOR ART)
FIG. 1*b* is an elevation sectional view of the perforating gun of FIG. 1*a;*

Referring to FIG. 1, a typical perforating gun, containing phased charges having a particular charge density and being phased to produce a particular pattern, is illustrated. This typical perforating gun is disclosed in U.S. Pat. No. 4,744,424, entitled "Shaped Charge Perforating Apparatus", the disclosure of which is incorporated by reference into this specification. In FIG. 1*b*, a front view of the typical perforating gun illustrates charges 10 that are phased, that is, pointed in different directions. FIG. 1*a* illustrates a plan view partially in cross section of FIG. 1*b*, wherein three charges 10*a*, 10*b*, and 10c are disposed consecutively adjacent one another with reference to a longitudinal axis disposed through the axial center of the gun. Charge 10*a* is disposed 135 degrees from charge 10*b*, and charge 10*b* is disposed 135 degrees from charge 10*c*. Therefore, adjacent charges, disposed along a surface parallel to the longitudinal axis, are angularly disposed 135 degrees from one another. However, although not specifically shown in the drawings of FIGS. 1*a* and 1*b*, assume each longitudinal row of charges in the gun of FIGS. 1*a*/1*b* is disposed 45 degrees from its adjacent longitudinal row. Therefore, in order to classify the phasing arrangement of the charges associated with the gun of FIG. 1*a* and 1*b*, a short hand notation of such phasing arrangement is defined to be "135/45", where the 135 represents the 135 degrees between adjacent charges disposed along a longitudinal surface of the gun, and the 45 represents the 45 degrees between adjacent rows of charges disposed longitudinally along a surface of the perforating gun.

Referring to FIGS. 2 and 3, two prior art phasing arrangements, associated with prior art perforating guns, is illustrated. The charge density for both FIGS. 2 and 3 is 12 shots per foot, although the phasing arrangement for FIG. 2 is different than FIG. 3, as described below.

In FIG. 2, two views of the phasing arrangement are illustrated: top section view of the perforating gun as shown in FIG. 2*a* with arrows showing the direction of perforations through holes (recesses) in the perforating gun carrier; and a flat opened-up section in FIG. 2*b*, where the gun of FIG. 2*a* is opened up in flat section to show the recesses in the perforating gun carrier. Note the pattern of recesses in the perforating gun carrier as shown in FIG. 2*b*. Using our adopted short hand notation defined above, the FIG. 2 phasing arrangement is "135/45", where the angular disposition between adjacent charges on a surface parallel to the longitudinal axis of the gun is 135 degrees, and the angular disposition between adjacent rows of charges is 45 degrees. The 45 degree disposition between adjacent rows and the 135 degree disposition between adjacent charges on a surface parallel to the longitudinal axis of the gun are shown in FIG. 2*b*. Note that the holes in the perforating gun carrier shown in FIG. 2*a* are distributed around an entire 360 circumference of the perforating gun.

In FIG. 3, the same two views of the phasing arrangement, as shown in FIG. 2, are also illustrated. Noting the pattern of recesses in the perforating gun carrier of FIG. 3*b*, using our adopted short hand notation, the FIG. 3 phasing arrangement is "120/120", where adjacent rows of charges are separated by 120 degrees, and adjacent charges disposed on a surface parallel to longitudinal axis of the gun are separated by 120 degrees.

Referring to FIG. 4, another prior art phasing arrangement, associated with a prior art perforating gun, is illustrated.

In FIG. 4, the charge density for this prior art gun is 5 shots per foot, and the phasing arrangement is "60/60", where adjacent rows of charges are separated by 60 degrees, and adjacent charges disposed on a surface parallel to longitudinal axis of the gun of FIG. 4 are angularly separated by 60 degrees.

Referring to FIG. 5, a perforating gun 12 is shown disposed in a deviated borehole lined by a casing 14. The gun 12 rests on the surface 16 of casing 14 when disposed in the deviated borehole. The gun 12 includes a gun carrier 12*a* in which a loading tube 12*b* is disposed. The charges 10 are disposed within the loading tube, and are phased in different directions. Depending upon the direction of phasing of the individual charges, a plurality of holes will appear on the surface of the loading tube 12*b* and a corresponding plurality of recesses will appear on the surface of the carrier 12*a*. The recesses will form a particular pattern on the surface of the carrier 12*a* and the holes will form a corresponding particular pattern on the surface of the loading tube 12*b*, depending upon the phasing arrangement of the charges 10 within the gun 12. The recesses in the carrier 12*a* are otherwise termed "scallops", as in 12*c*. For example, as shown in FIG. 5, a charge 10 points downwardly in the figure. Therefore, there must be a corresponding hole in the loading tube 12*b* and a corresponding recess (scallop) 12*c* in the carrier 12*a* to accommodate the direction in which charge 10 is pointing. Since there are a plurality of such charges 10, pointing in different directions, there are a corresponding plurality of recesses in the carrier and holes in the loading tube. If the carrier were cut longitudinally along its surface, and spread out onto a flat surface, a particular pattern of recesses would appear.

Referring to FIGS. 6 and 7, two separate patterns of holes or recesses, associated with two separate phasing arrangements of charges, in the loading tube 12*b* or carrier 12*a*, respectively, of the perforating gun of FIG. 5 is illustrated.

In FIG. 6, a carrier 12*a* is illustrated, the carrier being cut longitudinally along its surface, and being spread out onto a flat surface in order to illustrate the pattern of recesses in its surface, the pattern of recesses being further illustrative of the manner by which the charges 10 in the perforating gun of FIG. 5 are phased. The FIG. 6 embodiment of charge phasing arrangements comprises four rows, a first row a1, a second row a2, a third row a3, and a fourth row a4. The first and fourth rows a1 and a4 each include more recesses than do either one of the second row a2 or the third row a3. In fact, in FIG. 6, the first row a1 and the fourth row a4 each include twice as many recesses as do either the second row a2 or the third row a3. The first and fourth rows a1 and a4 have more recesses than do the second and third rows a2 and a3 for one simple reason: the first and fourth rows a1 and a4 of recesses are pointed in the left and right hand directions whereas the second and third rows a2 and a3 are pointed downwardly in the FIG. 6; consequently, more well fluid is interposed between the first and fourth rows a1 and a4 of the carrier 12*a*, and the casing 14, than is interposed between the second and third rows a2 and a3 and the casing 14. Therefore, more shots are positioned between the first and fourth rows a1 and a4, and the casing, than are positioned between the second and third rows a2 and a3, respectively. The second and third rows a2 and a3 are normally resting on or near the surface 16 of the casing 14, as illustrated by numeral 16 in FIG. 5, when the gun is disposed in a deviated (substantially horizontal) borehole. At this location, very little well fluid exists between the carrier 12*a* and the casing 14. However, from either point approximately 90 degrees on either side of numeral 16 in FIG. 5, and the casing 14, much more well fluid exists between the carrier 12*a* and the casing 14. This arrangement takes advantage of the fact that the charges perform substantially better after shooting through the increased amounts of wellbore fluid encountered by charges in rows a1 and a4 versus charges in rows a2 and a3. With the higher relative performance of the charges in rows a1 and a4 versus the charges in rows a2 and a3 and the higher percentage of charges in rows a1 and a4 (two thirds in rows a1 and a4, one third in rows a2 and a3) the overall gun system performance is maximized. Therefore, in the embodiment of FIG. 6, twice as many recesses in rows a1 and a4, and twice as many corresponding charges 10, are necessary, relative to the second and third rows a2 and a3, than are necessary in relation to the rows a2 and a3, and their corresponding charges. In any event, the recesses (or holes) shown in FIG. 6 are uniformly distributed solely along a 180 degree partial circumference (otherwise termed a 180 degree circumferential constraint) of the carrier 12*a* and the loading tube 12*b*, the recesses along this 180 degree partial circumference being adapted to point downwardly when the loading tube 12*b* and carrier 12*a* of the perforating gun of FIG. 5 are disposed approximately horizontally in a deviated borehole. Since the resulting holes in the casing 14 are also distributed uniformly, in the same manner as shown in FIG. 6, the casing 14 will not be split when the charges 10 detonate. Since there are more recesses and more charges 10, associated with rows a1 and a4, than are disposed in relation to rows a2 and a3, even though significant well fluid exists between rows a1 and a4 and the casing 14, a clean set of holes will exist in the casing and surrounding formation adjacent to rows a1 and a4, in addition to the clean set of holes which will automatically exist adjacent to rows a2 and a3. The embodiment of FIG. 6 is characterized by a charge density of 10 shots per foot and a phasing arrangement of "D180/60", where the "60" denotes that the adjacent rows of charges (within the 180 degree circumferential constraint) are each angularly separated by 60 degrees, and the "D180" denotes the downward or low side of the 180 degree circumferential constraint. Consequently, in view of the charge density of 10 shots per foot along the 180 degree partial circumference of the carrier, a significant quantity of formation fluid will be produced from the adjacent formation (adjacent the 180 degree partial circumference), even though only half of the total 360 degree formation is being perforated.

In FIG. 7, a further embodiment of charge phasing arrangements is illustrated. In this embodiment, the charge density is 9 shots per foot, and the recesses 12*c* in carrier 12*a* are constrained within the 180 degree partial circumference of the carrier, as before. Bearing in mind the 180 degree partial circumference constraint, the phasing arrangement of the FIG. 7 embodiment is characterized by "D180/45", where the "45" denotes the adjacent rows of charges are each angularly separated by 45 degrees, and the "D180" denotes the downward or low side 180 degree partial circumference constraint. Whereas the embodiment of FIG. 6 included four rows a1 through a4, the embodiment of FIG. 7 includes 5 rows of uniformly distributed recesses in carrier 12*a* and five corresponding rows of charges 10 in the perforating gun. Recall that the FIG. 6 embodiment included two rows a1 and a4, each of which had more (e.g., twice as many) recesses than did rows a2 and a3 (and there were more charges in each row a1 and a4 than were in each row a2 and a3). The reason for the greater number of recesses and charges in relation to rows a1 and a4 relative to rows a2 and a3 was the greater amount of well fluid interposed between rows a1 and a4 of carrier 12*a* and the casing 14 than was interposed between rows a2 and a3 of carrier 12*a* and the casing. In this FIG. 7 embodiment there are five rows a5–a9 of recesses and corresponding charges, instead of four as in the FIG. 6 embodiment, disposed along the 180 degree partial circumference of the perforating gun, the five rows pointing in a substantially downward direction when the carrier 12*a* of the gun is disposed approximately horizontally in a deviated borehole. Rows a5 and a6 are more closely separated (45 degrees) than were rows a1 and a2 (60 degrees). Similarly, rows a8 and a9 are more closely separated (45 degrees) than were rows a3 and a4 (60 degrees). All rows a5 through a9 shown in FIG. 7 have an equal number of recesses 12*c* and, in general, each of these rows a5 through a9 have fewer recesses 12*c* per foot of length than the rows a1 and a4 of FIG. 6. Therefore a wellbore casing perforated with a gun having the perforating phasing arrangement shown in FIG. 7 will have a higher remaining external collapse strength after perforating than the same wellbore casing perforated with a gun having the perforating phasing arrangement shown in FIG. 6, all other things being equal. Since the charges 10 and associated recesses of FIG. 7 are uniformly distributed along the 180 degree partial circumference of the carrier 12*a*, the casing 14 will not be split when the charges detonate. Since the charge density is 9 shots per foot, a significant amount of formation fluid will be produced from the formation adjacent the relevant 180 degree partial circumference of the perforating gun carrier.

Figure 8:
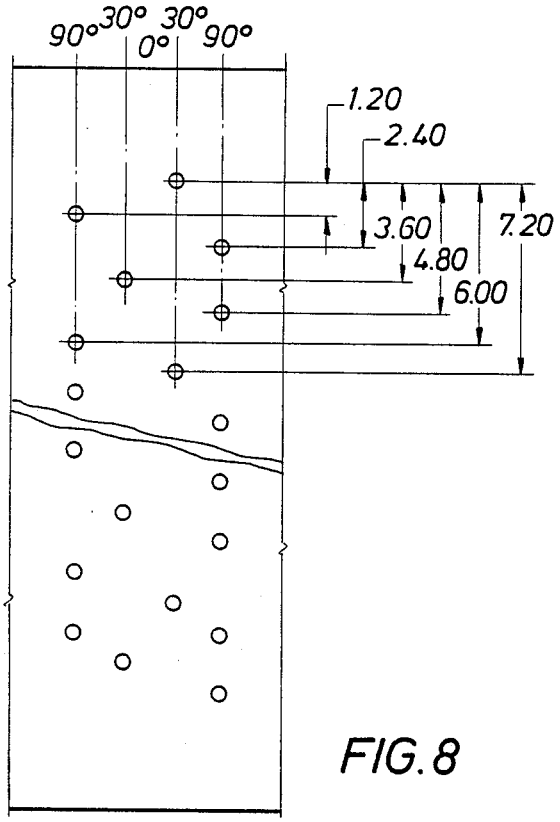
FIG. 8 illustrates the details of construction of the embodiment of FIG. 6.

Referring to FIG. 8, a more detailed construction of the embodiment of the invention shown in FIG. 6 is illustrated. In FIG. 8, the carrier 12*a* or loading tube 12*b* is shown cut longitudinally along its surface and spread out onto a flat surface in order to more fully illustrate the location of the recesses 12*c* in the carrier 12*a* or holes in the loading tube 12*b* as shown in FIG. 6.

Figure 9:
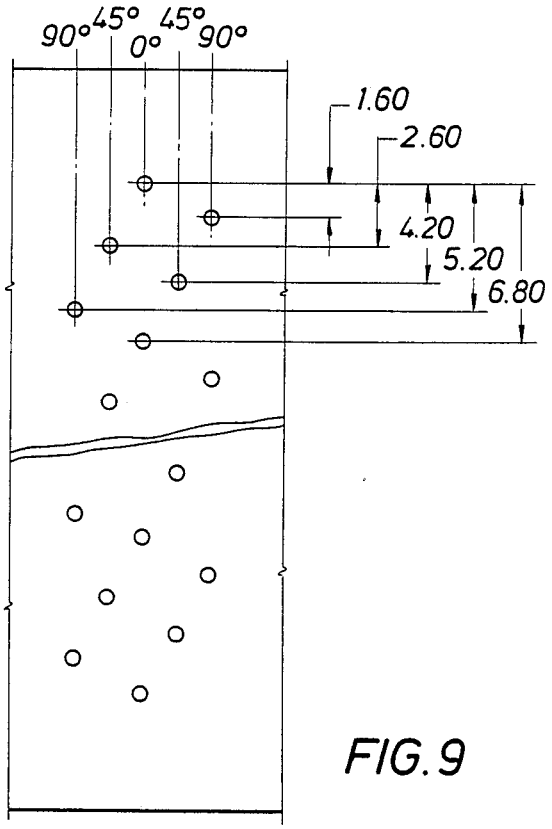
FIG. 9 illustrates the details of construction of the embodiment of FIG. 7.

Referring to FIG. 9, a more detailed construction of the embodiment of the invention shown in FIG. 7 is illustrated. In FIG. 9, the carrier 12*a* or loading tube 12*b* is shown cut longitudinally along its surface and spread out onto a flat surface in order to more fully illustrate the location of the recesses 12*c* in the carrier 12*a* or holes in the loading tube 12*b* as shown in FIG. 7.

Figure 10:
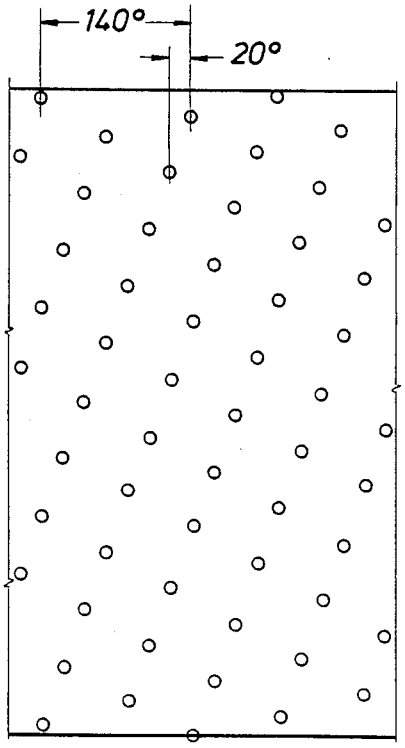
FIG. 10 illustrates a 14 shot per foot charge density embodiment distributed along the entire 360 degree circumference of the perforating gun in accordance with a further embodiment of the present invention.
Figure 10:
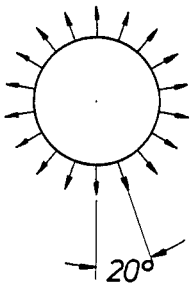

Referring to FIG. 10, a further phasing arrangement of charges in a perforating gun is illustrated.

In FIG. 10, the phasing arrangement shown need not be uniquely associated with a perforating gun disposed in a deviated borehole, since the charges 10 of this embodiment are disposed uniformly around the complete 360 degree circumference of the gun. The charge density of this embodiment is 14 shots per foot, and the phasing arrangement of charges 10 in a perforating gun is "140/20", where adjacent longitudinally disposed rows of charges are angularly separated by 20 degrees, and adjacent charges, disposed along a surface parallel to the same longitudinal center axis of the perforating gun, are angularly separated by 140 degrees, as illustrated in FIG. 10. The recesses of the pattern shown in FIG. 10 are likewise uniformly distributed around the circumference of the perforating gun.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A perforating gun adapted for use in a borehole, comprising:

a plurality of charges aligned in a plurality of rows located on a surface parallel to the longitudinal axis of said gun, each of said charges being constrained to point in a direction which lies within a partial circumference of said gun, the partial circumference being less than 360 degrees; and a carrier enclosing said charges, said carrier including a plurality of recesses corresponding, respectively, to said plurality of charges, said plurality of recesses including a first row of recesses having a first number of recesses per unit length, a second row of recesses having a second number of recesses per unit length, and at least one third row of recesses having a third number of recesses per unit length, said third row being interposed between said first and second rows of recesses, said first number of recesses per unit length being greater than said third number of recesses per unit length.

2. The perforating gun of claim 1, wherein said second number of recesses is greater than said third number of recesses.

3. The perforating gun of claim 1, wherein said first number of recesses is approximately equal to two times said third number of recesses.

4. The perforating gun of claim 3, wherein said second number of recesses is approximately equal to two times said third number of recesses.

5. The perforating gun of claim 1, wherein said plurality of charges have a charge density measured in shots per foot, said charge density being approximately 10 shots per foot.

6. The perforating gun of claim 2, wherein said plurality of charges have a charge density measured in shots per foot, said charge density being approximately 10 shots per foot.

7. The perforating gun of claim 1, further comprising a fourth row of recesses interposed between said first and second rows of recesses, and wherein each row of recesses is angularly disposed by approximately 60 degrees from an adjacent row of recesses.

8. The perforating gun of claim 2, further comprising a fourth row of recesses interposed between said first and second rows of recesses, and wherein each row of recesses is angularly disposed by approximately 60 degrees from an adjacent row of recesses.

9. The perforating gun of claim 8, wherein said plurality of charges have a charge density measured in shots per foot, said charge density being approximately 10 shots per foot.

10. A perforating gun adapted for use in a borehole, comprising: a plurality of charges aligned in a plurality of rows located on a surface parallel to the longitudinal axis of said gun, each of said charges being constrained to point in a direction which lies within a partial circumference of said gun, the partial circumference being less than 360 degrees, said plurality of rows including a first row of charges having a first number of charges per unit length, a second row of charges having a second number of charges per unit length, and at least one third row of charges having a third number of charges per unit length, said third row being interposed between said first and second rows of charges, said first number of charges per unit length being greater than said third number of charges per unit length.

11. The perforating gun of claim 10, wherein said second number of charges is greater than said third number of charges.

12. The perforating gun of claim 10, wherein said first number of charges is approximately equal to two times said third number of charges.

13. The perforating gun of claim 12, wherein said second number of charges is approximately equal to two times said third number of charges.

14. The perforating gun of claim 10, wherein said plurality of charges have a charge density measured in shots per foot, said charge density being approximately 10 shots per foot.

15. The perforating gun of claim 11, wherein said plurality of charges have a charge density measured in shots per foot, said charge density being approximately 10 shots per foot.

16. The perforating gun of claim 10 further comprising a fourth row of charges interposed between said first and second rows of charges, and wherein each row of charges is angularly disposed by approximately 60 degrees from an adjacent row of charges.

17. The perforating gun of claim 11, further comprising a fourth row of charges interposed between said first and second rows of charges, and wherein each row of charges is angularly disposed by approximately 60 degrees from an adjacent row of charges.

* * * * *